United States Patent [19]

Dyer et al.

[11] Patent Number: 4,793,385

[45] Date of Patent: Dec. 27, 1988

[54] HANDHELD TENSIONING AND CUT-OFF TOOL

[75] Inventors: Edward Dyer, Germantown; William K. Lueschen, Grafton, both of Wis.

[73] Assignee: Tyton Corporation, Milwaukee, Wis.

[21] Appl. No.: 170,035

[22] Filed: Mar. 18, 1988

Related U.S. Application Data

[63] Continuation of Ser. No. 899,017, Aug. 22, 1986, abandoned.

[51] Int. Cl.[4] ..... B21F 9/02

[52] U.S. Cl. ..... 140/123.6; 140/93.2

[58] Field of Search ..... 140/93 A, 93.2, 123.6

[56] References Cited

U.S. PATENT DOCUMENTS

| | | |
|---|---|---|
| 26,492 | 11/1968 | Caveney . |
| 29,973 | 4/1979 | Paradis . |
| 30,996 | 7/1982 | Pobuta . |
| 2,713,279 | 7/1955 | Harris . |
| 3,168,119 | 2/1965 | Schwester . |
| 3,254,680 | 6/1966 | Caveney . |
| 3,332,454 | 7/1967 | Lawson . |
| 3,344,815 | 10/1967 | Lawson . |
| 3,589,406 | 6/1971 | Moberg . |
| 3,610,296 | 10/1971 | Kabel . |
| 3,645,302 | 2/1972 | Caveney . |
| 3,661,187 | 5/1972 | Caveney . |
| 3,712,346 | 1/1973 | Noorily . |
| 3,735,784 | 5/1973 | Obuch . |
| 3,752,199 | 8/1973 | Fekette . |
| 3,782,426 | 1/1974 | Morgan . |
| 3,830,263 | 8/1974 | Benfer . |
| 3,853,155 | 12/1974 | Kabel . |
| 3,865,156 | 2/1975 | Moody . |
| 3,993,109 | 11/1976 | Fortsch . |
| 4,081,002 | 3/1978 | Violi . |
| 4,093,005 | 6/1978 | Eberhardt . |
| 4,129,157 | 12/1978 | Sciolotto . |
| 4,192,358 | 3/1980 | Bone . |
| 4,252,158 | 2/1981 | McDade . |
| 4,390,047 | 6/1983 | Kaneko . |
| 4,410,019 | 10/1983 | Suzuki . |
| 4,499,928 | 2/1985 | Furutsu . |
| 4,548,242 | 10/1985 | Paradis . |

*Primary Examiner*—Lowell A. Larson

*Attorney, Agent, or Firm*—Lockwood, Alex, FitzGibbon & Cummings

[57] ABSTRACT

A hand held tool for the tensioning and severing of cable ties is provided and includes linear reciprocating means for tensioning the cable tie tail, severing means to sever the tie tail flush with the cable tie head upon the attainment of a preselected tension level in the tie tail, actuating means which operatively connects the tensioning and severing means and which is capable of both pivotal and linear movement and means for applying a restraining force to the actuating means to restrain the actuating means to pivotal movement until the preselected tension is achieved in the cable tie tail, where upon the actuating means moves linearly and actuates the severing means to sever the tie tail. In addition, a selective tension adjusting mechanism comprising a rotating axial cam having a variety of cam surfaces angularly disposed thereon which engage a fixed surface on the tool and each of which corresponds to a preselected tension level to be attained in the cable tie.

59 Claims, 6 Drawing Sheets

HANDHELD TENSIONING AND CUT-OFF TOOL

This application is a continuation, of application Ser. No. 899,017, filed Aug. 22, 1986, now abandoned.

BACKGROUND AND SUMMARY OF THE INVENTION

The present invention relates generally to hand held tensioning and cutting tools, and particularly to an improved and reliable hand held tool for tensioning and cutting flexible cable ties.

Flexible cable ties are widely used in a variety of applications to bundle a plurality of elongate wires or cables. Such cable ties typically include an elongate tail portion which is threaded through an integral head portion to encircle the wires to be bound and the tie tail is drawn through the cable tie head to tightly bind the cables into a bundle. After the tie is tensioned around the cable bundle, the excess length of the tie tail which extends out of the head portion is then severed by the tool close to the head.

One disadvantage of many presently available tie tensioning and severing tools is that those tools require an operator to apply an excessive force on their triggers which leads tool operator fatigue after only a relatively small amount of cables ties have been installed by the operator Additionally, many prior art tie tensioning and severing tools have their tool triggers mechanically linked to the tensioning and severing mechanisms in a manner that the actual tension attained in the cable tie immediately prior to severing of the cable tie tail varies with the position of the operator's grip on the trigger during operation of the tool. Tools which rely upon mechanical linkages often increase the tension in the cable tie above the preselected value immediately prior to severing due to the movement of the linkages during the tensioning operation.

The present invention is directed to a hand-held tensioning and severing tool which avoids the aforementioned shortcomings.

In accordance with an important aspect of the present invention, an improved hand-held tie tool is provided which includes reciprocating means for tensioning the cable tie tail, means for severing the cable tie tail from the cable tie head when a preselected tension is attained in the cable tie and an actuating means adapted for both pivotal and linear movement which actuates the tie tensioning means in its pivotal movement and which actuates the tie severing means in its linear movement.

In accordance with another principal aspect of the present invention selective tension adjusting means is provided in the form of a first rotatable means for selectively changing the preselected tie tension to a first tension value and a second rotatable means for causing selective fine adjustment of the tension setting with respect to the first tension valve.

In accordance with still another aspect of the present invention a means for digitally indicating the preselected tension value of the cable tie is provided.

Accordingly, it is a general object of the present invention to provide a new and improved hand held tie tensioning and severing tool capable of reliable operation which consistently severs the cable tie tail at substantially uniform tension levels.

Another object of the present invention is to provide a hand tool for tensioning and severing cable ties which includes rotatable selective tension adjustment means for rapidly and reliably selecting a number of preselected tension levels.

Yet another object of the present invention is to provide a hand held tie-tensioning and severing tool having rotatable selective fine adjustment means for finely adjusting the preselected cable tie tension.

Still another object of the present invention is to provide a selective tensioning assembly in a hand held tie tensioning and severing tool wherein a number of distinct tie tension values can reliably be obtained.

Another object of the present invention is to provide an improved hand-held tie tensioning and severing tool which severs the cable tie tails of successively tensioned cable ties consistently at uniform tension levels irrespective of how the tool trigger is held by the operator.

It is still another object of the present invention to provide visual indicating means for digitally indicating the preselected tension value in the cable ties.

These and other objects, features and advantages of the present invention will be clearly understood through a consideration of the following detailed description.

DETAILED DESCRIPTION

In the course of this description, reference will frequently be made to the attached drawings in which.

Figure 1:
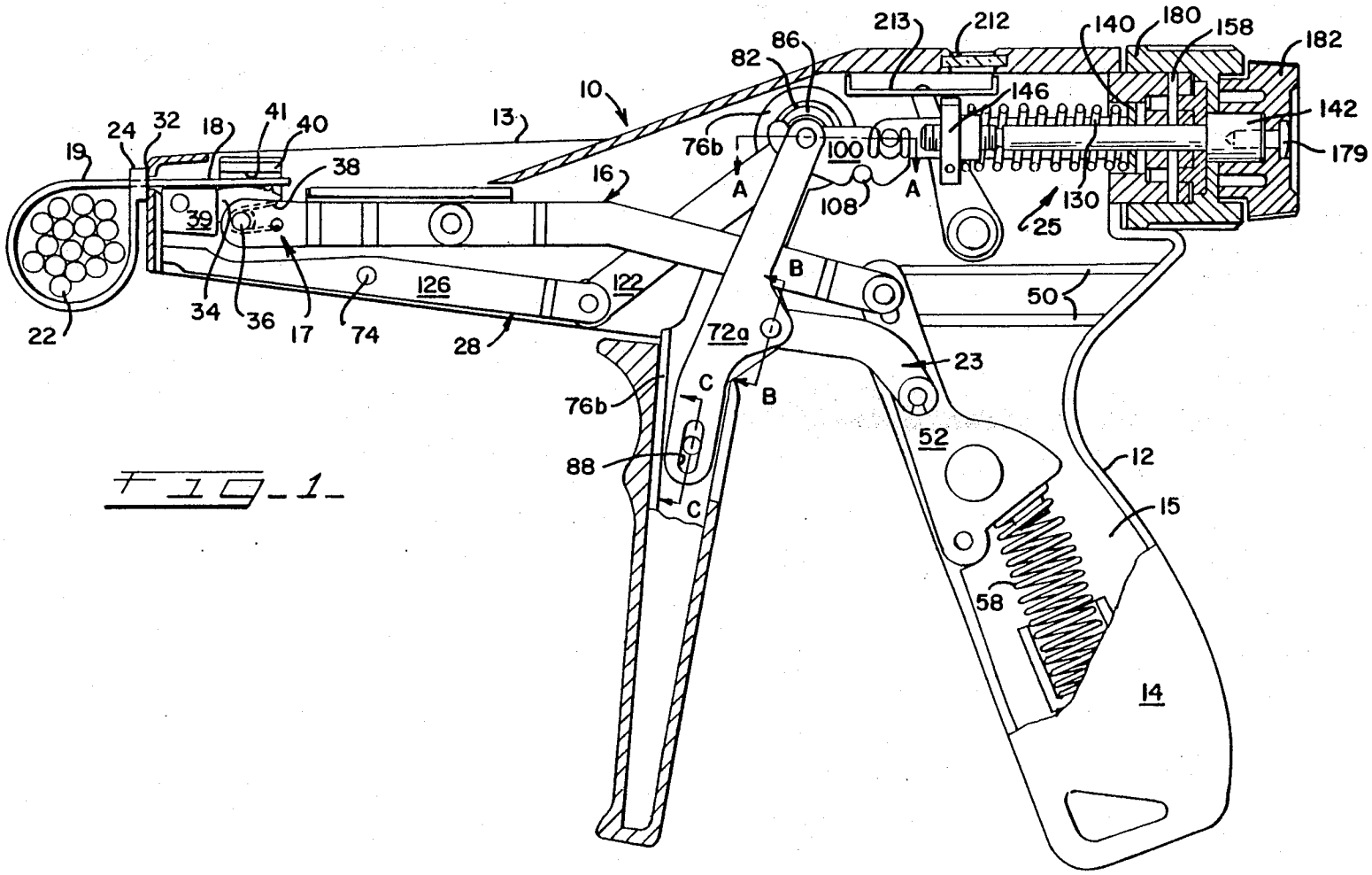
FIG. 1 is a side elevational view of a preferred embodiment of a hand-held tool constructed in accordance with the principles of the invention having a portion of the tool housing cutaway showing the internal parts and mechanisms of the tool.
Figure 2:
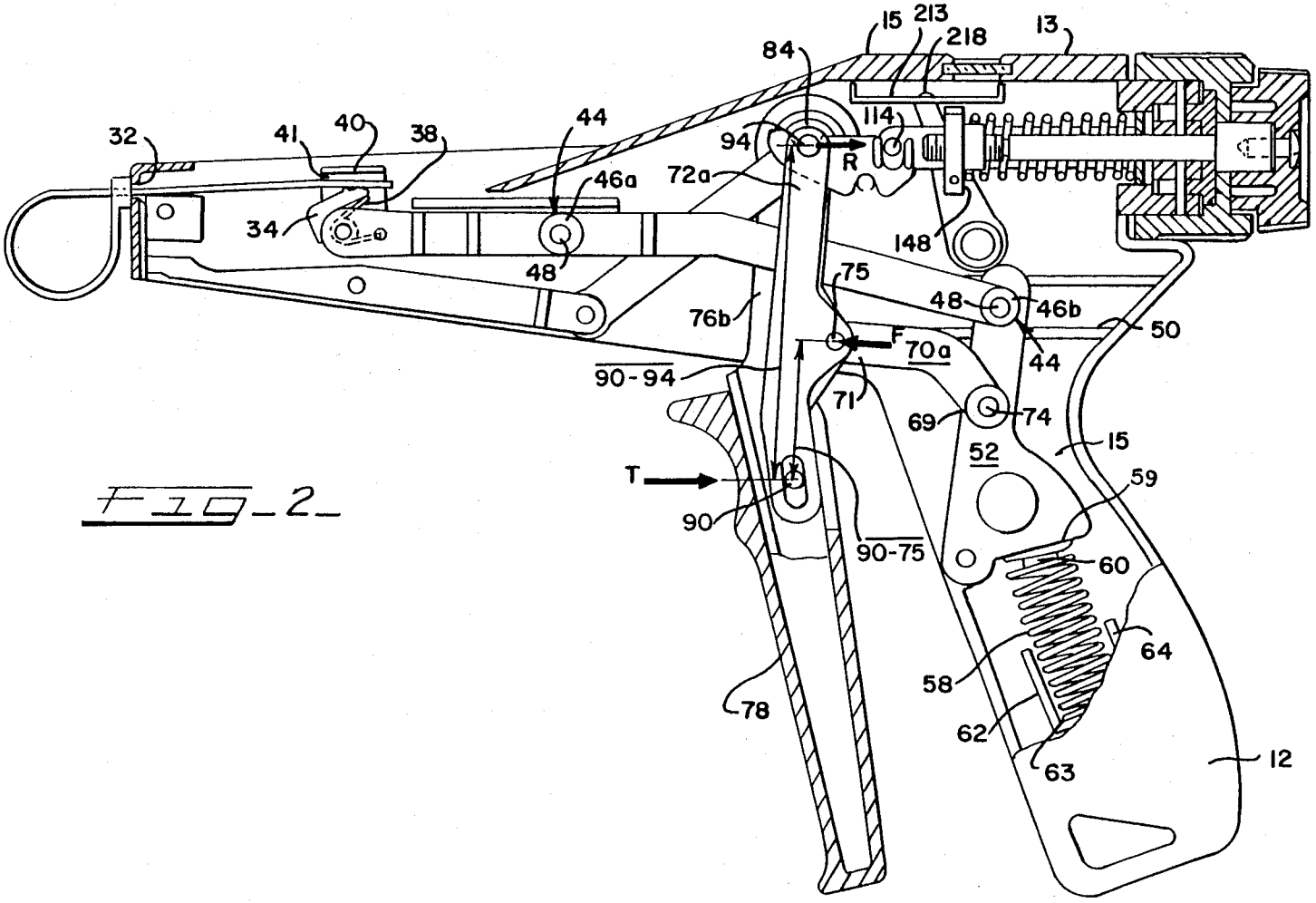
FIG. 2 is a cutaway view of the tool similar to FIG. 1, showing the tool after the trigger has been depressed and tension has been applied to the cable tie tail.
Figures 3, 3A:
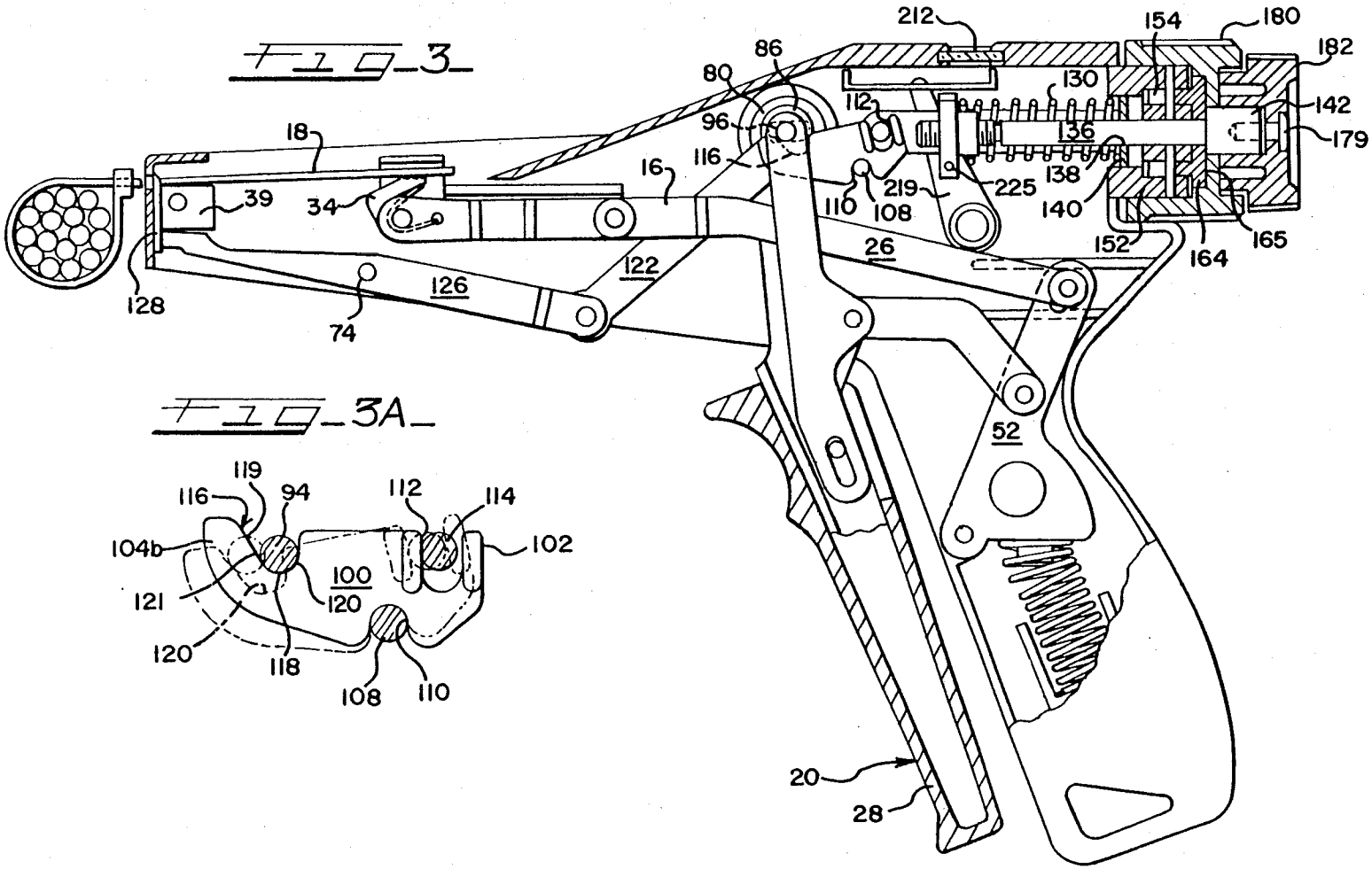
FIG. 3 is a cutaway view of the tool similar to FIG. 2, showing the tool immediately after the cable tie tail has been severed near the tie head.
FIG. 3A is a side elevational view of the cam mechanism used in the tool shown in FIGS. 1–3.

Referring now to the drawings, and in particular FIGS. 1–3, a preferred embodiment of a tie tool 10 incorporating the principles of the present invention is shown as having a housing 11 in the shape of a pistol or gun having a handle portion 12 and a barrel portion 13.

In FIGS. 1–3 one sidewall 14 of housing 11 has been cut away to show the other housing sidewall 15 and the internal parts and mechanism. The tool 10 generally contains a reciprocating tensioning member 16, formed by joining a pair of elongate pawl links 26 together, extending along the length of barrel 13 with a means for gripping 17 the tie tail 18 of a cable tie 19 located at the front end of the tensioning member 16. The tensioning member 16 is operatively connected by means of a mechanical linkage 23 to a manually operated trigger 20 which houses an actuating assembly 21. Actuating assembly 21 is also operatively connected to the selective adjustment tensioning mechanism 25 disposed in the rear of barrel 12 and a tie severing mechanism 28 disposed in the front of barrel 13.

Turning now to the details of the tensioning and gripping mechanism, the front of the tool barrel 13 is provided with a nose slot 32, through which the tool operator passes the tie tail 18 of a cable tie 19 with the serrations of the tie 19 facing up or down, after the tail 18 has been first passed around a bundle of wires 22 and threaded through the cable tie head 24. The tie tail 18 engages a tie-gripping pawl 34 which is rotatably held on a shaft 36 extending between the forward open ends of the two pawl links 26 by pawl shaft 36. The pawl 34 is biased for forward rotation counterclockwise about shaft 36 by a torsion spring 38 which applies a gripping pressure on the tie tail 18 held in a tie passageway 41 between a tie guide plate 40 and the pawl 34 to define the passageway 41 therebetween. By squeezing the tool trigger 20, the operator applies a rearward force to the pawl links 26 by way of mechanical linkage 23, thereby drawing the tie tail back toward the rear of tool 10 and tensioning the tie 19 around the wires 22.

When the tool is in its initial position (FIG. 1), the tensioning member 16 (and pawl links 26) are biased into their forwardmost extent within the tool barrel 13 by a return spring 58 located in the handle 12. In this position the pawl 34 abuts nose guide block 39. The contact between pawl 34 and nose guide block 39 slightly rotates the pawl 34 rearwardly (clockwise) and opens the tie passageway 41 between the pawl 34 and tie guide plate 40.

The pawl links 26 are restricted to substantially reciprocable linear movement within the tool housing 10 by guide means 44, which are shown as circular roller bearings 46*a,b* mounted on shafts 48 extending outwardly from and transverse to the pawl links 26. These bearings 46*a,b* ride within guide tracks 50 formed on the interior 43 of the housing sidewalls 14 & 15 and guide the tensioning member in its reciprocating, linear movement within the tool barrel 13.

Figure 8A:
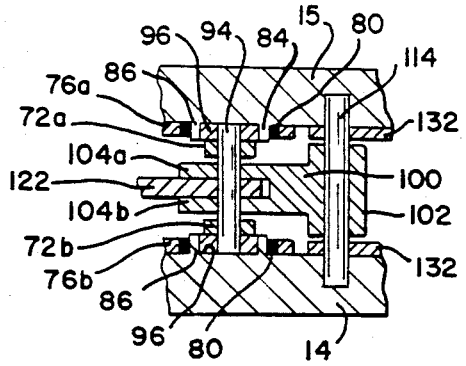
FIG. 8A is a sectional plan view taken along line A—A in FIG. 1.
Figure 8B:
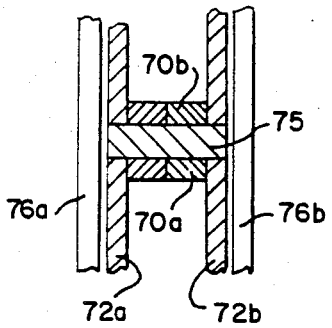
FIG. 8B is a sectional view taken along line B—B in FIG. 1.

The pawl links 26 are operatively connected to the mechanical linkage 23 which in turn is operatively connected to the actuating assembly 21. Pawl links 26 are joined to a handle link 52 by means of a roller shaft 48 which commonly connects those two links 26 & 52 and two roller bearings 46. Handle link 52 is pivotally mounted within the tool handle 12 by a pivot pin 54 seated in a housing boss 56 in the tool sidewalls. The return spring 58 engages the lower end 59 of the handle link 52 and is designed to provide a force sufficient enough to return the pawl links 26 and pawl 34 back to the front of the tool after the tie has been severed to right the pawl 34 and open up the tie passageway 41. The return spring 58 engages a tongue 60 at the handle link bottom 59 and is held under compression in a slot 62 between the handle link 52 and the slot base 63. The slot 62 is formed by walls 64 which protrude inwardly from the tool housing sidewalls 14 & 15. Return spring 58 also provides a constant force, approximately equivalent to the return spring constant, to partially resist the operator applied trigger force during tensioning. This resistance force is transmitted to the handle link 52 and translated therethrough to the two short links 70*a,b* and then to the actuating links 72*a,b* held within the trigger 20 at pivot pin 75. (FIG. 8B.).

The handle link 52 is operatively connected to the trigger 20 and the actuating assembly 21 by a pair of short links 70*a,b,* shown in FIGS. 1–3 as having a generally dogleg configuration and secured at one end 69 to handle link 52 by pivot pin 74. At their other end 71, the short links 70*a,b* are pivotally connected to actuating links 72*a,b* also by a pivot pin 75 which forms a balance point or fulcrum for the operating forces of the tool 10. Not only do these links 70*a,b* transmit the constant spring force of return spring 58 to the trigger 20 and actuating assembly 21 but they also operatively connect the actuating links 72*a,b* to the tensioning member 16. When the trigger 20 is depressed, the upper portion of handle link 52 slides backward in guide tracks 50, and draws the pawl links 26 rearwardly and applies a tensioning force to the cable tie 19.

Importantly, the pivot pin 75 connection between the short links 70*a, b,* and the actuating links 72*a,b* is located between the cam follower 94 and the trigger pivot pin 90 and provides a force fulcrum for the restraining force R and the trigger force T (FIG. 2). Preferably, this pivot point 75 is located at approximately 40% of the distance from trigger pivot pin 90 to the cam follower 94, that is, the length of a line segment drawn between 90–75 on the actuating link is 40% of the length of a line segment drawn between 90–94. With this relationship, a 60:40 mechanical advantage is obtained by the tension spring 130, so that a proportionally smaller tension spring 130 can be used in the tool than if the pivot point 75 were to be located at 50% (or greater) of the distance along trigger line 90–94. Consequently, a tension spring 130 having a relatively smaller spring constant or spring rate can be used in the tool and importantly, the force or torque required by the operator to turn the tension selection knob 180 to select a desired tension is considerably reduced, as will be explained in greater detail below.

Examining the trigger 20 and the actuating assembly 21 in greater detail, it can be seen that the actuating assembly comprises a pair of identical elongate actuating links 72*a,b* which are held in the trigger 20 between two elongate trigger links 76*a,b,* which are enclosed by a flexible trigger boot 78. Trigger links 76*a,b* extend from the base of the trigger 20 up into the barrel 13 where they are rotatably joined to the housing sidewalls 14 & 15 by way of trigger bearings 80. (See FIG. 8A) The trigger bearings 80 are held within a circular opening 82 in the top portion of each of trigger links 76*a,b*. Trigger bearings 80 are preferably substantially circular and rotatably engage circular bosses 84 which extend inward from the tool sidewalls 14,15 to form bearing hubs 86 around which the trigger links 76*a,b* and bearings 80 freely rotate.

Figure 8C:
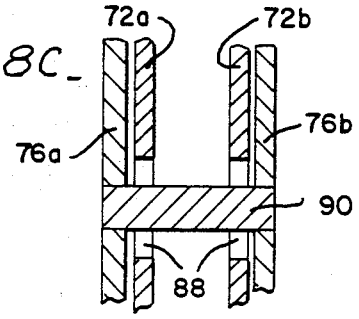
FIG. 8C is a sectional view taken along line C—C in FIG. 1.

The two actuating links 72*a,b* preferably have an elongate slot 88 formed in their lower ends 89 which receives a trigger pivot pin 90 extending between and fixed to the trigger links 76*a,b* to operatively connect the trigger 20 and the actuating assembly 21. (FIG. 8C.) As pivot pin 90 is fixed in its location between the trigger links 76*a,b,* it will be appreciated that the actuating link elongate slots 88 allow for the movement of actuating links 72*a,b* relative to the trigger pivot pin 90. Because the trigger 20 is pivotally fixed to the housing 11 at bearing hubs 86 the trigger pivot pin 90 always defines the same arc of rotation around the central axis of the bearing hub 86. As will be explained below, when the operator actuates the severing mechanism 28 (FIG. 3), the actuating links 72*a,b* pivot about a force fulcrum F at pivot 55 but do not pivot around the center of the bearing hub 86 which the trigger links rotate around, and the trigger pivot pin 90 moves rearwardly and downwardly in the trigger slot 88 relative to the actuating links 72*a,b*. At the top of the trigger and the actuating links 72*a,b,* a cam follower 94 in the form of an elongate shaft extends between the housing sidewalls 14, 15 and is held in place by an elongate guide slot 96 formed in the central portion of the bearing hub 86 extending generally horizontally within the tool housing 11. As will be explained in greater detail below, this guide slot 96 restricts the cam follower 94 to linear movement within the tool housing 11 and permits the cam follower 94 to move linearly in a forward direction toward the nose of the tool 10 when a preselected tension is attained in cable tie 19 (See FIG. 3) and actuate the severing mechanism 28.

In an important aspect of the present invention, the cutoff cam 100 (FIG. 3A) provides a means for actuating the severing mechanism 28 when a preselected tension is reached in the tie tail 18. Cutoff cam 100 is preferably formed from an integral generally U-shaped piece of durable metal and has a rear solid portion 102 from which two generally parallel cam arms 104 extend to form a cam yoke 106. The cutoff cam 100 is pivotally mounted in the barrel 13 by way of a cutoff cam pivot shaft 108 fixed to the tool housing 11 extending between the housing sidewalls 14, 15. Cam pivot shaft 108 is engaged in a pivot slot 110 formed in the lower middle of the cutoff cam 100 and it allows rotation or pivoting of the cutoff cam 100 counterclockwise around the cam shaft 108. A second cam slot 112 is located in the rear portion 102 of cutoff cam 100 and engages a tensioning spring engagement pin 114 which operatively connects the cutoff cam 100 (and its associated actuating assembly 21) to the selective tensioning adjustment assembly 25. Second cam slot 112 is elongate to allow vertical movement therein by engagement pin 114 when the cam 100 rotate around the cam pivot shaft 108 (FIG. 3A.)

A third cam slot 116 is formed in the forward end of the cam yoke 106 and provides a cam surface on each cam arm 104 and which includes two distinct cam surfaces 118 and 119. The first cam surface 118 generally comprises the rear portion of cam slot 116 (FIG. 3A) and forms a generally semi-circular depression 120 at the bottom of the cam slot 116. The second cam surface 119 is located adjacent to and forward of first cam surface 118 and has a generally planar surface forming a cam ramp 121 which begins approximately where the curvature of the first cam surface 118 ends. A rearward restraining force R is applied to the cutoff cam 100 via spring engagement pin 114 and restrains the cutoff cam 100 from rotating around the cam pivot shaft 108 when the trigger 20 is depressed until the preselected tension is attained in the tie operator is tensioning a cable tie 19. During the initial depression of trigger 20, the cam follower 94 remains in the semi-circular depressions 120 of the first cam surface 118. As the trigger is further depressed, the trigger 20 continues to pivot around a fixed point at the center of the bearing hub 86. When the tension in the tie 19 approaches the preselected tension, 18, the trigger force applied by the operator applied to the trigger 20 exceeds the tension spring restraining force and the two actuating links 72*a,b* pivot in unison counterclockwise around the force fulcrum located at pivot pin 75 and the to of actuating links 72*a,b* instantaneously advance the cam follower 94 forwardly in a linear motion in the horizontal housing guide slots 96 out of the first cam surface depression 120 along the adjacent second cam surface 119 As the cam follower 94 moves forward, the cam follower 94 rides up the second surface cam ramp 121, rotating the cutoff cam 100 counterclockwise around its pivot shaft 108. The cam follower 94 then operatively engages a cutoff link 122 held between the cam arms 104 of cam yoke 106 and forces it forward, which in turn causes rotation of a blade link 126 pivotally attached to the housing 11 by a pivot pin 74. The blade link 126 pivots clockwise and upward around pin 74, thereby bringing a tie-severing blade 128 upward into contact with the tie tail 18 and severing the tail 18 generally adjacent the cable tie head 24. Because the tension spring 130 constantly exerts a restraining force on the cutoff cam 100 during the tensioning and the movement of cam follower 94 from the first cam surface 118 to the second cam surface 119 is virtually instantaneous, the tie is severed flush with the tie head while under tension, thereby ensuring that the preselected tension value is attained in the tie 19.

The present invention also provides a novel selective tensioning assembly 25 which enables the operator to rapidly select one of a number of preselected tension levels in the tie by rotation of tension knobs 180 or 182. As explained above, the tensioning assembly 25 applies a rearward force on the cutoff cam 100 via the tension engagement pin 114 to restrain the cuttoff cam 100 from rotating forwardly around its pivot shaft 108. This restraining force is created in the tension spring 130 and transferred to the cutoff cam 100 by the engagement pin 114 held within the rear wall 103 of cutoff cam 100.

Figures 4, 5:
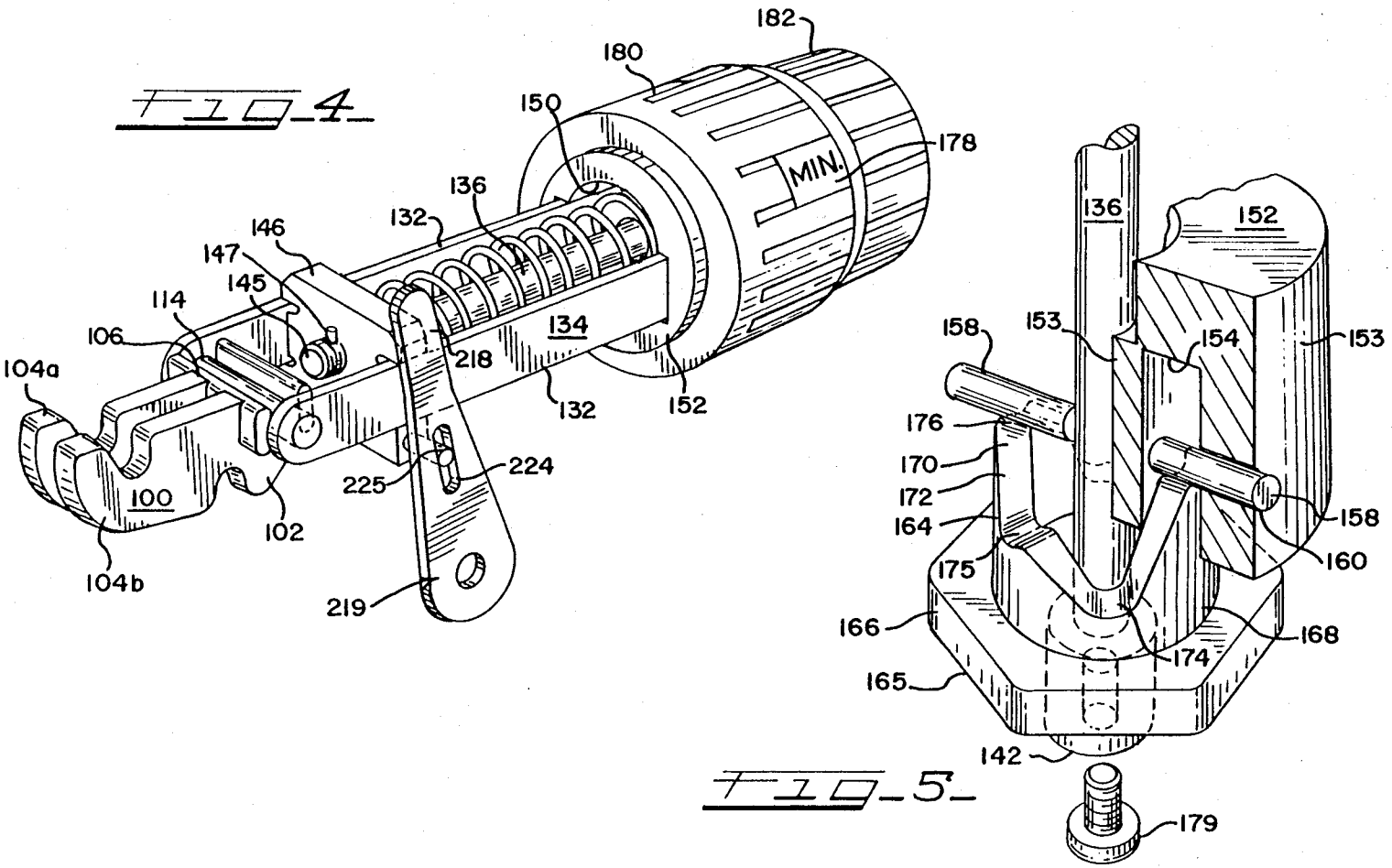
FIG. 4 is a perspective view of a preferred embodiment of the tie tensioning mechanism used in the tool shown in FIGS. 1–3.
FIG. 5 is a cutaway perspective view of part of the tensioning mechanism of FIG. 4.

FIG. 4 shows a preferred embodiment of a selective tensioning assembly 25 incorporating the principles of the present invention which comprises a tension spring 130 held between two arms 132 of a U bracket 134. The spring 130 encircles a tension shaft 136 axially disposed within the bracket arms 132 A tension engagement pin 114 joins the bracket arms 132 together at the front of the bracket 134, while the rear of the bracket includes an endplate 140 which has an generally cylindrical opening 138 to accommodate the passage therethrough of the tension shaft 136. The rear end of tension shaft 136 includes an enlarged diameter portion 142 (shown in phantom in FIG. 5) which abuttingly engages the back surface 165 of axial cam 164. Tension shaft 136 has a threaded portion 145 at its front end which threadedly engages a threaded tension nut 146. In the initial tool position (FIG. 1), the tension spring 130 is subjected to a slight preload or compression due to its placement between the tension nut 146 and the bracket endplate 140 (compressed approximately 0.060 inches from its free length). It will be seen that any rearward movement of the tension nut 146 on tension shaft 136 will increase the compression on spring 130, and increase the rearward or restraining force that the spring 130 exerts upon the cutoff cam 100.

As best seen in FIG. 5, bracket 134 fits in a recess 150 of a fixed cam 152, this cam being fixed to the tool barrel 13 at the rear of tool housing 11 Fixed cam 152 includes two axially and generally cylindrical walls 153 which define an annular slot 154 therebetween which accommodates the cylindrical extension 168 of an axial cam 164. Two crosspieces 158 extend radially through the fixed cam outer wall 153 and are held in a fixed relationship to each other approximately 180° apart in two radial openings 160. These crosspieces 158 protrude into the fixed cam slot 154, and define a fixed point of engagement on the tool 11 for the axial cam distinct cam surfaces 174, 175 & 176.

Figure 9A:
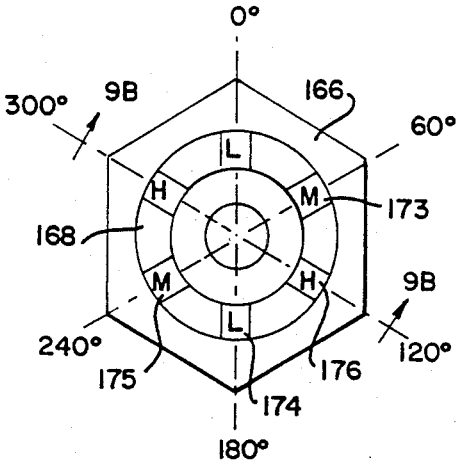
FIG. 9A is a plan view of the axial cam.
Figure 9B:
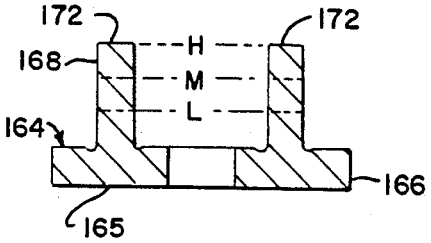
FIG. 9B is a sectional view taken along line B—B in FIG. 9A.
Figure 9C:
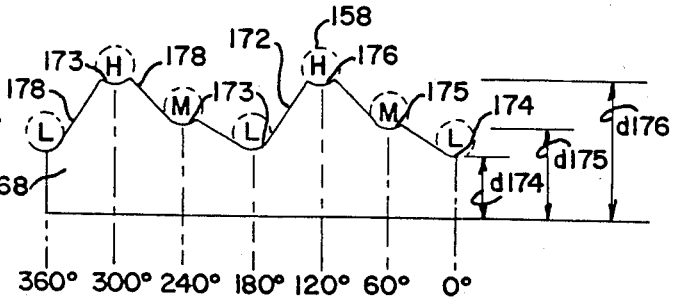
FIG. 9C is a diagram showing the profile of the cam surfaces of the axial cam of FIG. 9A.

The base 166 of axial cam 164 preferably has a non-circular configuration, (shown in FIG. 5 as a hexagon) so that it engagingly fits within a complimentary shape recess (not shown) centered in the tension or cam knob 180 and provides a means of operative engagement between them such that the axial cam 164 rotates with tension knob 180 when the latter is turned by the tool operator. A generally cylindrical cam extension 168 extends axially outwardly from the cam base 166, the axial face of this extension 168 providing a generally circular cam surface 172. This axial cam surface 172 is further divided into pairs of cam surfaces, (FIGS. 5 & 9A–C.) as three distinct pairs 174, 175 & 176 each pair having a different length of axial extent from the cam base 166, represented in FIG. 9C a $d_{174}$, $d_{175}$, and $d_{176}$. Individual depressions 173 are located at the ends of the cam surface pairs and are generally semi-circular in configuration. The depressions 173 engage the complimentary cylindrical configuration of the fixed crosspieces 158 and are spaced 180° apart from one another. Each pair of cam surfaces shown in the drawings are spaced 60° apart from their adjacent pair.

In operation, the compression of the tension spring is increased by the operator rotating the tension knob 180 which also rotates the axial cam 164. A pair of cam surface depressions 173 engage the crosspieces 158 to establish a preselected compression or preload of tension spring 130. Because the back 165 of axial cam 164 engages the enlarged diameter 142 of tension shaft 136, the tension nut 146 is drawn rearwardly toward the bracket endplate 140 (Which is fixed in its location in the fixed cam recess 150) a distance corresponding to the height of the cam surface chosen on the axial cam 164. When the first pair of axial cam surfaces 174 engage the crosspieces 158, the distance between the tension nut rear face 148 and the bracket endplate 140 is substantially at a maximum and thus the compression exerted on tension spring 130 is at a minimum setting. Turning the tension knob 180 either clockwise or counterclockwise to the next tension setting brings the the next pair of cam surface depressions 173 into engagement on the fixed crosspieces 158, which increases the compression o spring 130 (and decreases the distance between the tension nut 146 and bracket endplate 140) by an amount equal to the extent of the axial cam pair. Increasing the compression in the tension spring 130 in this manner increases the restraining force applied to the cutoff cam 100 via engagement pin 114. Due to the 60:40 mechanical advantage described above, the tension spring force R is smaller and the torque required by the operator to rotate tension knob 180 (and hence increase the compression on tension spring 130) is reduced, thereby reducing operator fatigue Visual indicators 178 may be affixed to the outer circumference of tension knob 180 to indicate to the operator which preselected tension value is chosen.

A second tension adjustment knob 182 is provided so that the operator has a means for finely adjusting or "fine-tuning" the tension values chosen by rotation of tension knob 180. Knob 182 is fixedly attached to the tension shaft 136 by means of a screw 179 which connects the fine adjustment knob 182 to shaft 136 (FIGS. 1–3) in the enlarged diameter shaft portion 142 so that the shaft 136 and knob 182 are co-rotatable. Thus, rotation of the tension shaft 136 moves the threaded tension nut 146 a slight distance forward or backward on the threaded shaft portion 145, dependent on the direction of rotation of knob 182. Shaft 136 extends axially through a common circular and coaxial opening in tension knob 180, axial cam 164 and the fixed cam 152 so that when shaft 136 is rotated by turning the fine adjustment knob 182, the shaft 136 does not rotatably engage either the tension knob 180 or the axial cam 164. The front shaft portion 145 is threaded for a limited distance only (by way of stop 147) to limit the extent of travel thereon by tension nut 146 and correspondingly limit the amount of fine adjustment in the compression of spring 130. By turning the fine adjustment knob 182, the operator can slightly increase or decrease the spring length between the tension nut 146 and the rear of U-bracket 112.

Figure 7:
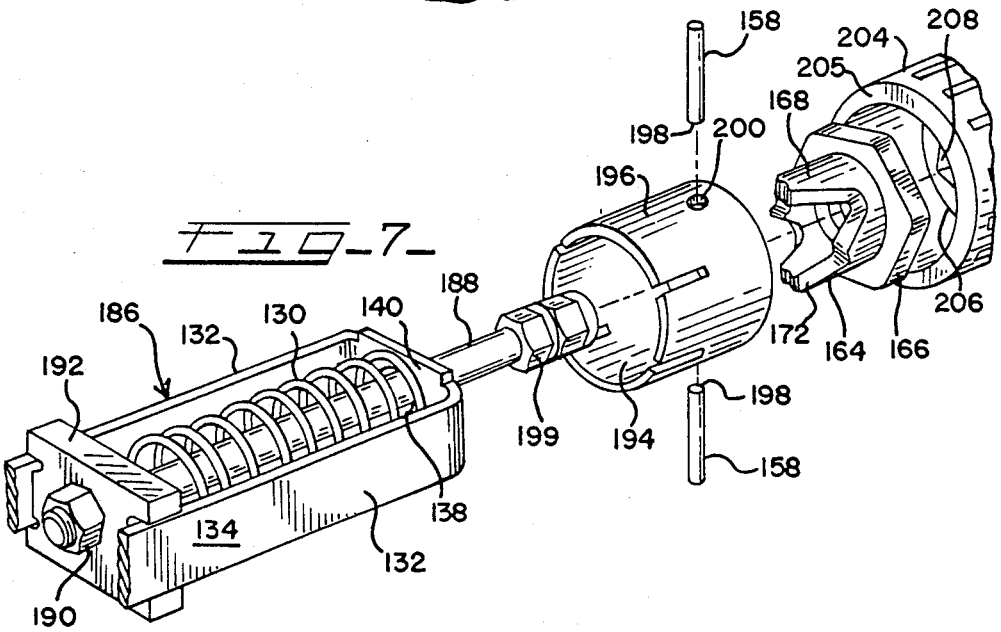
FIG. 7 is an exploded perspective view of a second emdodiment of a tensioning mechanism constructed in accordance with the present invention.

A second embodiment of a tension assembly 186 constructed in accordance with the present invention is shown in FIG. 7. This embodiment is similar in construction to the preferred embodiment described above except that one knob 204 is used for adjustment of tension level and fine adjustment instead of two and the cam knob 204 is keyed to the shaft 188. A moveable spring stop on the shaft 188 is provided by tension nut 190 which threadedly engages the shaft 188 between the bracket arms 132 when it moves along tension shaft 188. The tension nut 190 is fixed to the end of shaft 188 and provides a stop on shaft 188 to limit the travel of spring stop 192 on the shaft 188.

The tension spring 130 is held between the bracket endplate 140 and the spring stop 192, and this bracket-spring assembly is seated in a recess 194 of fixed cam 196. A pair of crosspieces 158 extend radially inwardly through the fixed cam 196 via radial openings 200, and as the fixed cam 196 has no annular slot 154 the ends 198 of the crosspieces 158 terminate near the tension shaft 188. These crosspieces provide a fixed point of engagement for the pairs of axial cam surfaces 174, 175 & 176. The axial cam 164 used in this embodiment is identical in all respects to the axial cam used in the preferred embodiment described above.

Only one tension adjustment knob 204 is provided in this second embodiment Cam knob 204 has a non-circular recess 206 which engages the irregular (hexagonal) base 166 of the axial cam 164, and also has a central axial keyway 208 which engages shaft end nuts forming a shaft hex section 199 so that rotation of tension knob 204 turns both the axial cam 164 and shaft 188 to move the spring stop 192 on tension shaft 188 when the base 205 of the knob 204 abuts the rear of the tool housing 11. If only fine adjustment of the tension is desired, the operator can move cam knob 204 slighty rearwardly on shaft 188 to disengage the knob 204 from the axial cam base 166 and the rotation of ca knob 204 will only rotate the shaft 188 and not the axial cam 164, the knob 204 engaging the shaft hex section 199.

Figure 6A:
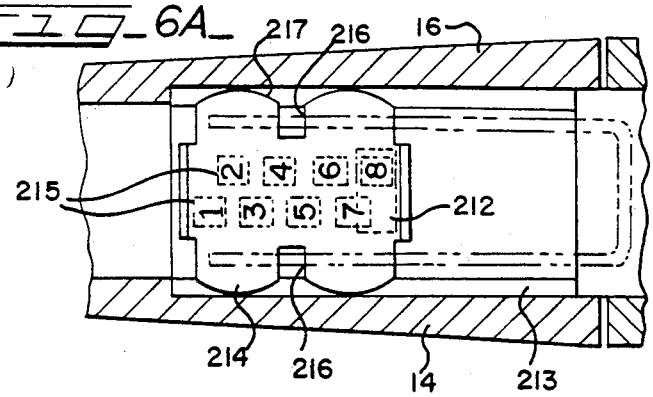
FIG. 6A is a plan view taken along line A—A in FIG. 6.
Figure 6:
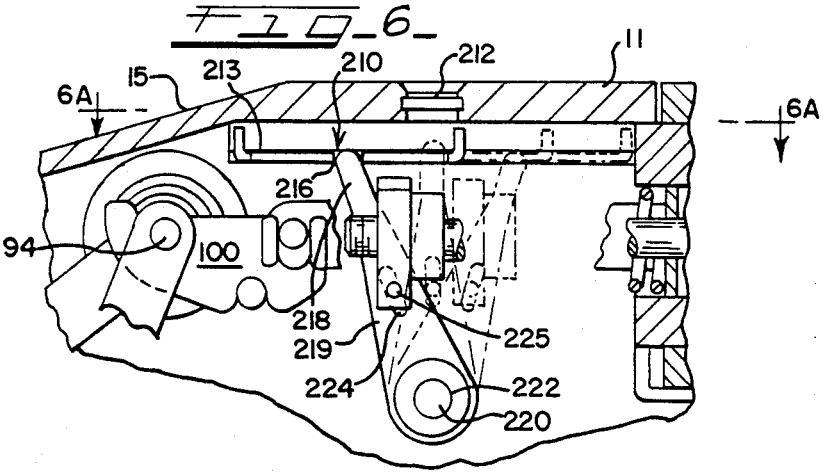
FIG. 6 is a fragmentary elevational view of the tool shown in FIGS. 1–3 showing the digital tension indicator and fine tensioning adjustment mechanism.

A means for visually indicating the adjustment level setting is shown generally as 210 in FIGS. 6–6A. A window 212 is provided in the top of the tool housing 11 over the tensioning assembly 25. Guide tracks 213 are formed in the housing sidewalls 14 & 15 and support a display plate 214 which is slideable on the tracks 213. The display plate 214 has a plurality of tension value indicating digits 215 thereon arranged in two vertical rows generally parallel to the longitudinal axis of the tool in which the individual digits in one row are vertically offset from the individual digits in the other row so that only one digit may fully appear through the window 212 at any one time. Each indicating digit 215 on the display plate 214 is approximately the same size as the housing window 212 so that the operator can dial one digit corresponding to a preselected tension value into view beneath window 212 Sliding display plate 215 is generally flat and has means for engaging the tensioning assembly 25 in the form of parallel notches 216 in the length 217 of display plate 214. These notches 216 engage fingers 218 of either one or a pair of indicator levers 219, which are attached to the housing sidewalls 14 & 15 by pivotal means shown in the Figures as a housing boss 220 engaged by a circular opening 222 at the lower end of indicator lever(s) 219. At approximately the middle of arm(s) 219, a pair of elongate slots 224 engage two pins 225 on the tension nut 146 which extend outwardly therefrom generally transverse to the tension shaft 136 and below the tensioning assembly U-bracket arms 132. It will be appreciated that by virtue of this connection, any movement of the tension nut 146 on the tension shaft 136 will move the indicator lever(s) 219 parallel to the tension shaft correspondingly slide the display plate 214 beneath the window 212, as shown in phantom in FIG. 6 to bring a different tension value indicating digit 215 into view in the window 212 to thereby indicate the tension value setting of the tool.

For example, when the tension knob 180 is rotated to set the axial cam 164 on its low position (where cam surface pair 174 engage the crosspieces 158), the digit "2" will substantially appear in the indicator window 212. Turning the tension knob 180 to the next intermediate position (where cam surface 175 engages the crosspieces) will cause the digit "4" to substantially appear in the window, while turning the knob 180 once again engages cam surface 176 on the crosspieces in its high tension setting so that digit "7" substantially appears in the window 212. Turning the fine adjustment tension knob 182 in either direction so that the tension nut 146 advances its maximum distance either forward or backward on the shaft 136 will cause the two digits numerically adjoining the digit obtained from the tension knob 180 to substantially appear in the window 212. In the case of the low, intermediate and high tension settings mentioned above, the digits "1" or "3", "3" or "5", or "6" or "8" respectively will appear in the window 212, dependent on the direction of maximum rotation of knob 182. The maximum stroke of the display plate 214 (that is the travel distance between digits "1" and "8" appearing in display window 212) is approximately 0.630 inches To effect this stroke the tension nut 192 travels a distance of approximately 0.296 inches on the tension shaft 136. A 2:1 movement multiplier for the tool is thereby attained, which allows the size of indicating digits 215 to be increased for greater visibility to the tool operator.

In operation, a cable tie tail 18 is inserted into the nose slot 32 with the tool at its normal, initial position (FIG. 1) with the tie head 24 positioned adjacent the nose slot 32. As the trigger 20 is depressed by the operator toward the handle 2, the trigger links 76 *a,b* and the actuating links 72*a,b* rotate around a fixed point in the center of bearing hub 86, generally occupied by the cam follower 94 which rotates in the first cam surface depression 120. The pawl links 26 are drawn rearward sliding in guide tracks 50 causing the handle link 52 and the short links 70*a,b* to pivot about their pivot pins 74. As the tension on the pawl links 26 increases due to the closing of the cable tie loop around the bundle of wires 22, a force equal to the tension in the tie (the tie input force, F) is translated through the handle link 52 and the short links 70*a,b* forward to the pivot point 75 of the actuating links 72*a,b* which serves as the fulcrum for operation of the cutoff cam 100 by the actuating links 72*a,b*. Two rearward forces act to oppose this tie input force. One force, T, is from the operator depressing the trigger 20 and is transmitted from the trigger 20 to the actuating link trigger pivot pin 90. The second force is the restraining force, R, supplied by the tension spring 130 which applies a rearward force on the cutoff cam 100 through the axial cam 164, the fixed cam 152 and the U-bracket 134. A balance is established when the total rearward forces T&R equal the forward force F. At this equilibrium point, the severing mode of the tool begins. (FIG. 3.)

The severing mode begins when the operator-applied trigger force exceeds the restraining force supplied by the tension spring and presented through the 60:40 mechanical advantage found on the actuating links 72*a,b*. At this instant, the pair of actuating links 72*a,b* act as if it is a beam supported on a fulcrum (pivot point 90) with the restraining force R pulling one end of it rearward at cam follower 94 and the trigger force T pulling the other end rearward at trigger pivot pin 90. As the trigger force T exceeds the tension spring restraining force R, the pair of actuating links 72*a,b* (the beam) will pivot counterclockwise around its pivot point 90 and the top of those links will move forwardly while the trigger 20 maintains its fixed pivotal axis around the center of the bearing hub 86. The cam follower 94 is urged out of the first cam surface depression 120 by the pivoting of actuating links 72*a,b* to the cam ramp 121 of the second cam surface 119 to move linearly thereon (FIG. 3A). The movement of cam follower 94 moves the cutoff link 122 forward which causes the blade link 126 to rotate around pivot pin 74 to move the blade 128 upward to sever the tie tail 18. Due to this unique mechanical linkage arrangement, the tool gives reliable and consistent tensioning and clean, flush severing results, with tensioning repeatability obtained in the cable ties in a tolerance level of $\pm 2\frac{1}{2}$ lbs.

While the preferred embodiments of the invention have been shown and described, it will be obvious to those skilled in the art that changes and modifications may be made therein without departing from the spirit of the invention, the scope of which is defined by the appended claims.

What is claimed is:

1. A tool for tensioning and severing an elongate cable tie having a tie head portion and tie tail portion comprising, means for gripping and tensioning the tail of the cable tie capable of reciprocating linear movement, means for severing the cable tie tail adjacent said cable tie head upon attainment of a preselected tension in said tie, actuating means including an actuating link for actuating said tensioning means and being capable of pivotal and linear movement, said actuating means being operatively connected to said severing means and said tie tensioning means, and restraining means for restraining said actuating means to pivotal movement until a preselected tension is achieved in said cable tie tail by said tensioning means, whereupon said actuating means moves linearly and said actuating link actuates said severing means and severs said tie tail adjacent said tie head.

2. The tool of claim 1, further including rotatable means for selectively adjusting the tension attained in said cable tie tails.

3. The tool of claim 2, wherein said selective tension adjusting means comprises first rotatable means rotatable about a preselected axis of said tool for selectively changing the restraining force in preselected values to cause a corresponding change in the level of tension attained in said cable tie tail and second rotatable means also rotatable about said preselected axis of said tool for causing selective fine adjustment of the restraining force with respect to each of said first rotatable means preselected tension values.

4. The tool of claim 3, wherein said first and second rotatable means rotate independent of each other.

5. The tool of claim 3, wherein said first and second rotatable means rotate concurrent with each other.

6. The tool of claim 3, further including visual indicating means for visually indicating the preselected tension level chosen by the operator, comprising slideable display means operatively connected to said first and second rotatable means to indicate the preselected tension value setting of said first and second rotatable means.

7. The tool of claim 3, further including a housing having first guide means thereon for guiding said tensioning means in said reciprocating linear movement, said tensioning means including roller bearing means slideably engaging said first guide means and second guide means thereon operatively connecting said actuating means with said housing.

8. The tool of claim 3, wherein said selective tension adjusting means further includes fixed cam means, rotational cam means operatively connected to said first rotatable means, said rotational cam means operatively engaging said fixed cam means at a fixed point thereon, threaded shaft means axially disposed within said rotational cam means said first and second rotatable means, said shaft means having stop means moveably disposed at one end of said shaft, spring means axially disposed on said tension shaft means between said fixed cam means and said shaft stop means, said spring means exerting restraining force upon said actuating means.

9. The tool of claim 8, wherein said rotational cam means includes a generally cylindrical axial cam, one end of said axial cam defining a continuous cam surface having a plurality of distinct cam surfaces angularly disposed thereon, whereupon the restraining force of the spring is selectively changed in preselected values which correspond to selected positions of said axial cam when said distinct cam surfaces individually engage said fixed cam at said fixed point.

10. The tool of claim 9, wherein each of said axial cam includes a plurality of pairs of distinct cam surfaces, each of said pairs being spaced 60° apart from adjacent pairs of cam surfaces.

11. The tool of claim 1, wherein said actuating means includes cam means operatively connected to said restraining means and said severing means.

12. The tool of claim 11, wherein said cam means includes a cam surface and a cam follower operatively connecting said actuating means to said severing means and to said cam means, said cam surface including a first cam surface which allows pivotal movement thereon by said cam follower and a second cam surface adjacent said first cam surface which allows linear movement thereon by said cam follower.

13. The tool of claim 12, wherein said restraining means further includes a spring applying a restraining force on said cam means to prevent movement thereof until a preselected tension is achieved in said cable tie.

14. The tool of claim 12, wherein said restraining means further includes a spring applying a restraining force on said cam means to restrain said cam follower to pivotal movement on said first cam surface until a preselected tension is achieved in said cable tie.

15. The tool of claim 1, further including means for visually indicating the preselected tension value of said cable tie, said indicating means including slideable display means operatively connected to said restraining means.

16. The tool of claim 1, wherein said actuating means includes an actuator and cam means operatively connected both to said actuator and said severing means by a cam follower, said cam means having a generally arcuate first cam surface which allows pivotal movement of said cam follower thereon and a generally planar second cam surface adjacent said first cam surface which allows linear movement of said cam follower thereon, said cam follower being restrained to pivotal movement on said first cam surface by said restraining means until said preselected cable tie tension is attained, whereupon said actuator moves said cam follower linearly from said first cam surface to said adjacent second cam surface, thereby bringing said cam follower into operative engagement with said severing means and actuating said severing means.

17. The tool of claim 16, further including a tool housing having guide means thereon for guiding said cam follower in its linear movement.

18. The tool of claim 16, wherein said actuator is operatively connected to said tensioning means by linkage means.

19. The tool of claim 1, further including trigger means operatively connected to said actuating means and linkage means operatively connecting said actuating means to said tensioning means.

20. The tool of claim 19, wherein said linkage means is operatively connected to said actuating means between said actuating means-trigger operative connection and said actuating means-severing means operative connection.

21. The tool of claim 20, wherein said actuating means-linkage means operative connection is located on said actuating means at 40% of the distance from said actuating means-trigger means operative connection to said actuating means-severing means operative connection.

22. The tool of claim 21, wherein said trigger means is pivotally fixed to said tool.

23. The tool of claim 22, wherein said linkage means is pivotally attached to said tool.

24. A tool for tensioning and severing an elongate cable tie having a tie head portion and tie tail portion comprising, means for gripping and tensioning the tail of the cable tie capable of reciprocating linear movement, means for severing the cable tie tail adjacent said cable tie head when a preselected tension is attained in said tie, means for actuating said tensioning and severing means, said actuating means including an actuating link and being capable of pivotal and linear movement, said actuating means further being operatively connected to said severing means and said tie tensioning means, restraining means for restraining said actuating means to pivotal movement until a preselected tension is achieved in said cable tie tail by said tensioning means, whereupon said actuating means moves linearly and said actuating link actuates said severing means and severs said tie tail adjacent said tie head, and selective tension adjusting means for selectively adjusting the preselected tension attained in said tie tail, including first rotatable means rotatable about a preselected axis of said tool for causing selective fine adjustment of the restraining force with respect to each of said first means preselected tension values.

25. The tool of claim 24, wherein said first and second rotatable means rotate independent of each other.

26. The tool of claim 24, wherein said first and second rotatable means rotate concurrent with each other.

27. The tool of claim 24, wherein said actuating means includes cam means operatively connected to said restraining means and said severing means.

28. The tool of claim 27, wherein said cam means includes a cam surface and cam follower operatively connecting said actuating means to said severing means and to said cam means, said cam surface including a first cam surface thereon allowing pivotal movement thereon by said cam follower and a second cam surface thereon adjacent said first cam surface allowing linear movement thereon by said cam follower.

29. The tool of claim 28, wherein said restraining means further includes a spring applying restraining force to said cam means to prevent the linear movement of said cam follower on said second cam surface until a preselected tension is achieved in said cable tie.

30. The tool of claim 27, wherein said restraining means further includes a spring applying a restraining force to said cam means to prevent the movement thereof until a preselected tension is achieved in said cable tie.

31. The tool of claim 24, further including visual indicating means for visually indicating the preselected tension level of said cable tie, and having slideable display means operatively connected to said restraining means.

32. The tool of claim 24, further including visual indicating means for visually indicating the preselected tension value chosen by the operator, comprising slideable display means operatively connected to said first and second rotatable means to indicate the preselected tension value setting of said first and second rotatable means.

33. The tool of claim 24, wherein said selective tension adjusting means further includes fixed cam means, rotational cam means operatively connected to said first rotatable means, said rotational cam means operatively engaging said fixed cam means at a fixed point thereon, threaded shaft means axially disposed within said rotational cam means said first and second rotatable means, said shaft means having stop means moveably disposed at one end of said shaft, spring means axially disposed on said tension shaft means between said fixed cam means and said shaft stop means, said spring means exerting a restraining force upon said actuating means.

34. The tool of claim 33, wherein said rotational cam means includes a generally cylindrical axial cam, one end of said axial cam defining a continuous cam surface having a plurality of distinct cam surfaces angularly disposed thereon, whereupon the restraining force of the spring is selectively changed in preselected values which correspond to selected positions of said axial cam when said distinct cam surfaces individually engage said fixed cam at said fixed point.

35. The tool of claim 24, wherein said actuating means is operatively connected to trigger means and said operative connection between said actuating means and said tensioning means includes linkage means.

36. The tool of claim 24, further including trigger means operatively connected to said actuating means and linkage means operatively connecting said tensioning means to said actuating means, the point of operative connection between said linkage means and said actuating means occurring between the point of operative connection between said trigger means and said actuating means and the point of operative connection between said actuating means and said severing means.

37. The tool of claim 36, wherein the point of operative connection between said linkage means and said actuating means occurs at approximately 40% of the distance from said actuating means-trigger means operative connection to said actuating means-severing means operative connection.

38. A tool for tensioning and severing an elongate cable tie having a tie head portion and tie tail portion comprising, means for gripping and tensioning the tail of the cable tie capable of reciprocating linear movement, means for severing the cable tie tail adjacent said cable tie head when a preselected tension is attained in said tie, actuating means including an actuating link for actuating said tensioning and said severing means and being capable of pivotal and linear movement, said actuating means being operatively connected to said severing means and said tie tensioning means, restraining means for restraining said actuating means to pivotal movement until a preselected tension is achieved in said cable tie tail by said tensioning means, whereupon said actuating means moves linearly and said actuating link actuates said severing means and severs said tie tail adjacent said tie head, selective tension adjusting means for selectively adjusting the preselected tension attained in said tie tail, including first rotatable means rotatable around a preselected axis in said tool for selectively changing the restraining force in preselected values to cause a corresponding change in the level of tension of said cable tie tail and second rotatable means also rotatable around the preselected axis for causing selective fine adjustment of the restraining force with respect to each of said first means preselected tension values, and visual indicating means for visually indicating the preselected tension level of said cable tie including slideable display means operatively connected to said restraining means.

39. The tool of claim 38, wherein said slideable display means is operatively connected to said first and second rotatable means to indicate the preselected tension value setting of said first and second rotatable means.

40. The tool of claim 39, wherein said actuating means includes an actuator and cam means operatively connected to said actuator link and said severing means by a cam follower, said cam means including a first, generally arcuate cam surface which allows pivotal movement of said cam follower thereon and a second, generally planar cam surface adjacent said first cam surface which allows linear movement of said cam follower thereon, said cam follower being restrained to pivotal movement on said cam means by said restraining means until said preselected cable tie tension is attained, whereupon said actuator link urges said cam follower from said first cam surface to said second cam surface, thereby bringing said cam follower into operative engagement with said severing means and actuating said severing means.

41. The tool of claim 38, wherein said selective tension adjusting means further includes fixed cam means, rotational cam means operatively connected to said first rotatable means, said rotational cam means operatively engaging said fixed cam means at a fixed point thereon, threaded shaft means axially disposed within said rotational cam means said first and second rotatable means, said shaft means having stop means moveably disposed at one end of said shaft, spring means axially disposed on said tension shaft means between said fixed cam means and said shaft stop means, said spring means exerting a restraining force upon said actuating means.

42. The tool of claim 41, wherein said rotational cam means includes a generally cylindrical axial cam, one end of said axial cam defining a continuous cam surface having a plurality of distinct cam surfaces angularly disposed thereon, whereupon the restraining force of the spring is selectively changed in preselected values which correspond to selected positions of said axial cam when said distinct cam surfaces individually engage said fixed cam at said fixed point.

43. The tool of claim 38, wherein said actuating means is operatively connected to trigger means and said operative connection between said actuating means and said tensioning means includes linkage means.

44. The tool of claim 38, further including trigger means operatively connected to said actuating means and linkage means operatively connecting said tensioning means to said actuating means, the point of operative connection between said linkage means and said actuating means occurring between the point of operative connection between said trigger means and said actuating means and the point of operative connection between said actuating means and said severing means.

45. The tool of claim 44, wherein the point of operative connection between said linkage means and said actuating means occurs at approximately 40% of the distance from said actuating means trigger means operative connection to said actuating means-severing means operative connection.

46. In a tie tool for tensioning and severing an elongate cable tie having a tie head portion and a tie tail portion, said tool including means for gripping and tensioning the cable tie, means for severing the cable tie tail adjacent the tie head portion upon the attainment of a preselected tension in said tie, and means for actuating both said tensioning means to tension said tie and said severing means to sever said tie when said preselected tension is achieved in said tie, a selective tension adjusting assembly comprising means for applying a restraining force for restraining said actuating means from actuating said severing means until said preselected tension is attained in said tie, fixed cam means fixed to said took, first rotatable means rotatable with respect to said fixed cam means and rotatable around a preselected axis of said tool and adapted to change the restraining force of said restraining means in fixed values and second rotatable means also rotatable around said preselected axis for selectively finely adjusting said restraining force with respect to said fixed values.

47. The selective tension adjustment assembly of claim 46 wherein said restraining means includes a spring operatively engaging said actuating means to exert a restraining force thereon, said first rotatable means includes axial cam means rotatably engaging said fixed cam means and operatively engaging said spring such that rotation of said axial cam means will change the restraining force of said spring exerted upon said actuating means, and said second rotatable means is operatively connected to said spring such that rotation of said second rotatable mean will change the restraining force of said spring exerted upon said actuating means.

48. The selective tension adjustment assembly of claim 47, wherein said axial cam means includes a plurality of distinct cam surfaces angularly disposed thereon and engaging said fixed cam means, each distinct cam surface being spaced at different distances from said spring to engage said fixed cam means to cause a corresponding change in the restraining force exerted by said spring.

49. The selective tensioning assembly of claim 48, wherein said second rotatable means is mounted for movement relative to said first rotatable means when said axial cam engages said fixed cam means with any of its distinct cam surfaces such that the restraining force of said spring may be further selectively changed with respect to each of fixed tension values 50. A tool for tensioning and severing an elongate cable tie having a tie head portion comprising, means for gripping and tensioning the tail of the cable tie capable of reciprocating linear movement, means for severing the cable tie tail adjacent said cable tie head upon attainment of a preselected tension in said tie, actuating means for actuating said tensioning means and being capable of pivotal and linear movement, said actuating means being operatively connected to said severing means and said tie tensioning means, said actuating means including cam means operatively connected to said restraining means and said severing means, said cam means including a cam surface and a cam follower operatively connecting said actuating means to said severing means and to said cam means, said cam surface including a first cam surface which allows pivotal movement thereon by said cam follower and a second cam surface adjacent said first cam surface which allows linear movement thereon by said cam follower, and restraining means for restraining said actuating means to pivotal movement until a preselected tension is achieved in said cable tie tail by said tensioning means, whereupon said actuating means moves linearly to actuate said severing means and sever said tie tail adjacent said tie head.

51. The tool of claim 50, wherein said restraining means further includes a spring applying a restraining force on said cam means to prevent movement thereof until a preselected tension is achieved in said cable tie.

52. The tool of claim 50, wherein said restraining means further includes a spring applying a restraining force on said cam means to restrain said cam follower to pivotal movement on said first cam surface until a preselected tension is achieved in said cable tie.

53. A tool for tensioning and severing an elongate cable tie having a tie head portion and tie tail portion comprising, means for gripping and tensioning the tail of the cable tie capable of reciprocating linear movement, means for severing the cable tie tail adjacent said cable tie head upon attainment of a preselected tension in said tie, actuating means or actuating said tensioning means and being capable of pivotal and linear movement, said actuating means and said tie tensioning means, and restraining means for restraining said actuating means to pivotal movement until a preselected tension is achieved in said cable tie tail by said tensioning means, whereupon said actuating means moves linearly to actuate said severing means and sever said tie tail adjacent said tie head, said actuating means including an actuator and cam means operatively connected both to said actuator and said severing means by a cam follower, said cam means having a generally arcuate first cam surface which allows pivotal movement of said cam follower thereon and a generally planar second cam surface adjacent said first cam surface which allows linear movement of said cam follower thereon, said cam follower being restrained to pivotal movement on said first cam surface by said restraining means until said preselected cable tie tension is attained, whereupon said actuator moves said cam follower linearly from said first cam surface to said adjacent second cam surface, thereby bringing said cam follower into operative engagement with said severing means and actuating said severing means.

54. The tool of claim 53, further including a tool housing having a guide means thereon for guiding said cam follower in its linear movement.

55. The tool of claim 53, wherein said actuator is operatively connected to said tensioning means by linkage means.

56. A tool for tensioning and severing an elongate cable tie having a tie head portion and tie tail portion comprising, means for gripping and tensioning the tail of the cable tie capable of reciprocating linear movement, means for severing the cable tie tail adjacent said cable tie head when a preselected tension is attained in said tie, means for actuating said tensioning and severing means, said actuating being capable of pivotal and linear movement and being operatively connected to said severing means and said tie tensioning means, restraining means for restraining said actuating means to pivotal movement until a preselected tension is achieved in said cable tie tail by said tensioning means, whereupon said actuating means moves linearly to actuate said severing means and sever said tie tail adjacent said tie head, said cam means including a cam surface and cam follower operatively connecting said actuating means to said severing means and to said cam means, said cam surface including a first cam surface thereon allowing pivotal movement thereon by said cam follower and a second cam surface adjacent said first cam surface allowing linear movement thereon by said cam follower, and selective tension adjusting means for selectively adjusting the preselected tension attained in said tie tail, including first rotatable means for selectively changing the restraining force in preselected values to cause a corresponding change in the level of tension of said cable tie tail and second rotatable means for causing selective fine adjustment of the restraining force with respect to each of said first means preselected tension values.

57. The tool of claim 56, wherein said restraining means further includes a spring applying a restraining force to said cam means to prevent the movement thereof until a preselected tension is achieved in said cable tie.

58. The tool of claim 56, wherein said restraining means further includes a spring applying a restraining force to said cam means to prevent the linear movement of said cam follower on said second cam surface until a preselected tension is achieved in said cable tie.

59. A tool for tensioning and severing an elongate cable tie having a tie head portion and tie tail portion comprising, means for gripping and tensioning the tail of the cable tie capable of reciprocating linear movement, means for severing the cable tie tail adjacent said cable tie head when a preselected tension is attained in said tie, actuating means for actuating said tensioning and said severing means and being capable of pivotal and linear movement, said actuating means being operatively connected to said severing means and said tie tensioning means, restraining means for restraining said actuating means to pivotal movement until a preselected tension is achieved in said cable tie tail by said tensioning means, whereupon said actuating means moves linearly to actuate said severing means and sever said tie tail adjacent said tie head, selective tension adjusting means for selectively adjusting the preselected tension attained in said tie tail, including first rotatable means for selectively changing the restraining force in preselected values to cause a corresponding change in the level of tension of said cable tie tail and second rotatable means for causing selective fine adjustment of the restraining force with respect to each of said first means preselected tension values, visual indicating means for visually indicating the preselected tension level of said cable tie including slideable display means operatively connected to said restraining means, said slideable display being operatively connected to said first and second rotatable means to indicate the preselected tension value setting of said first and second rotatable means, and said actuating means including an actuator and cam means operatively connected to said actuator link and said severing means by a cam follower, said cam means including a first, generally arcuate cam surface which allows pivotal movement of said cam follower thereon and a second, generally planar cam surface adjacent said first cam surface which allows linear movement of said cam follower thereon, said cam follower being restrained to pivotal movement on said cam means by said restraining means until said preselected cable tie tension is attained, whereupon said actuator link urges said cam follower from said first cam surface to said second cam surface, thereby bringing said cam follower into operative engagement with said severing means and actuating said severing means.

* * * * *

UNITED STATES PATENT AND TRADEMARK OFFICE

CERTIFICATE OF CORRECTION

PATENT NO. : 4,793,385

DATED : December 27, 1988

INVENTOR(S) : Dyer et al.

It is certified that error appears in the above-identified patent and that said Letters Patent is hereby corrected as shown below:

Column 1, line 57, "valve" should read --value--.

Column 6, line 8, "to" should read --top--; line 12, after "119", insert a period --.--; line 47, after "132", insert a period --.--.

Column 7, line 1, after "11", insert a period --.--; line 26, after "9C", "a" should read --as--; line 65, after "fatigue", insert a period --.--.

Column 8, line 52, after "embodiment", insert a period --.--; line 63, "ca" should read --cam--.

Column 9, line 14, after "212", insert a period --.--.

Signed and Sealed this

Second Day of May, 1989

*Attest:*

*Attesting Officer*

DONALD J. QUIGG

*Commissioner of Patents and Trademarks*